United States Patent [19]

Osborne

[11] Patent Number: 4,964,279

[45] Date of Patent: Oct. 23, 1990

[54] COOLING SYSTEM WITH SUPPLEMENTAL THERMAL STORAGE

[75] Inventor: William T. Osborne, Anne Arundel, Md.

[73] Assignee: Baltimore Aircoil Company, Jessup, Md.

[21] Appl. No.: 629,660

[22] Filed: Jun. 7, 1989

[51] Int. Cl.[5] ..... F25D 3/00

[52] U.S. Cl. ..... 62/59; 62/201; 62/434; 62/526

[58] Field of Search ..... 62/59, 434, 238.6, 432, 62/431, 199, 428, 201, 524, 525, 526; 165/18

[56] References Cited

U.S. PATENT DOCUMENTS

| | | | |
|---|---|---|---|
| 1,523,112 | 1/1925 | Fitzgerald | 62/201 X |
| 1,782,651 | 11/1930 | Hoffman | 62/201 X |
| 2,120,185 | 6/1938 | Philipp | 62/201 X |
| 2,460,623 | 2/1949 | Zoppola | 62/434 |
| 2,712,732 | 7/1955 | McGraw | 62/526 X |
| 2,718,122 | 9/1955 | Grimshaw | 62/526 X |
| 4,637,219 | 1/1987 | Grose | 62/199 |
| 4,741,178 | 5/1988 | Fujiu et al. | 62/525 |

*Primary Examiner*—Lloyd L. King

*Attorney, Agent, or Firm*—Edward J. Brosius; Charles E. Bouton

[57] ABSTRACT

The present invention provides a cooling system with supplemental thermal storage. The cooling system comprises a compressor, an evaporative condenser, a thermal storage unit, and an evaporator. During normal outdoor temperatures when building cooling is desired, the compressor output is connected to the evaporative condenser which in turn is connected to the evaporator coil. During periods of time when the building is not occupied, the evaporator coil is removed from the cooling circuit and the working fluid passing through coils in the thermal storage unit acts to freeze liquid surrounding the coils within the thermal storage unit tank. During unusually warm outdoor temperatures, when additional building cooling is required, the compressor output is connected to the evaporative condenser which in turn is connected to the thermal storage unit which output is in turn connected to the evaporative coil. During such operation, additionally chilled working fluid is provided to the evaporator coil due to the working fluid passing through the coils of the thermal storage unit and thereby being further chilled due to the frozen liquid surrounding the coils in the thermal storage unit.

8 Claims, 4 Drawing Sheets

COOLING SYSTEM WITH SUPPLEMENTAL THERMAL STORAGE

BACKGROUND OF THE INVENTION

The present invention relates generally to an air cooling system, and more particularly, to an air cooling system with the capability to provide supplemental cooling through the use of a thermal storage device.

Mechanical air cooling or air conditioning systems are well known and are in use in most commercial or office buildings. Such air conditioning systems typically have demands or load that vary considerably with the outdoor conditions including the degree of sunlight, temperature and humidity and also with the building occupancy. The greatest demand on such systems usually occurs in the afternoon hours when the combined effects of these influences are most severe. Most commercial and office buildings are closed during the late evening and nighttime hours, and consequently, the demand on the air conditioning system varies from a peak in the afternoon period to the very low or zero demand during the evening and nighttime hours.

It is accordingly desirable to provide an air cooling or air conditioning system that can provide desired air conditioning to a commercial building during normal warm outdoor conditions and yet also have a sufficient reserve supply to provide adequate air conditioning to the building during peak conditions during unusually warm, sunny and humid outdoor conditions. One way to provide such an air conditioning system is to size the system such that the peak demand can be mechanically met by the various system components. However, this is undesirable from a installation cost point of view due to the capital investment required for system components such as compressors, condensers, interconnecting piping and electrical wiring and switchgear. Another consideration is the relatively high cost to operate such systems due to the demand charge levied by the electrical utilities on the maximum instantaneous electrical demand of the compressor when indeed the maximum electrical draw is only required a relatively few days during the cooling season. The operating cost is an even greater consideration in regions where the utilities penalize units of electricity consumed in the afternoon with time-of-day pricing.

Another more desirable method of meeting the peak system cooling demands without necessarily sizing all of the system components to meet the peak cooling demand is to utilize supplemental thermal storage. The term thermal storage when applied to cooling systems actually refers to the storage of cooling capacity, usually in the form of a frozen phase change material which is utilized to further chill a liquid used in the air cooling or air conditioning system. One recent disclosure of such a system for storing cooling capacity is set forth in U.S. Pat. No. 4,720,984. This patent recognizes the reduced cooling needs for a building during nighttime hours and discloses the use of the chilled water outlet of a cooling tower to freeze a phase change material during such nighttime hours. The phase change material is said to be included in a storage tank containing packages of a salt composition phase change material having a freezing-melting point above the temperature of the chilled liquid emerging from the cooling tower. When the packages of the salt compositions are frozen, the phase change material can be remelted during the following peak building cooling demand by providing additional chilling to the water exiting the cooling tower by allowing such water to pass through the tank in close proximity to the packaged phase change material and exiting from the tank. The phase change material is accordingly remelted and assists the mechanical chiller in the cooling of the water in the building loop. Such system requires the use of an intermediate water loop, the major components of which are a cooling tower, a chiller, and a thermal storage tank, to transfer the cooling effect from the cooling equipment to the building.

Accordingly, it is an object of the present invention to provide an air cooling system having supplemental thermal storage capacity which does not require the use of an intermediate water loop.

It is another object of the present invention to provide an efficient air cooling system having supplemental thermal storage capability that need only be utilized when required to provide additional cooling capacity.

SUMMARY OF THE INVENTION

The present invention provides an air cooling or air conditioning system having the capacity to provide supplemental cooling when the air conditioning so requires it. Most typically, such air cooling system would be applied on a commercial or office building having an air conditioning load that varies with the outdoor temperature, sunlight, and humidity conditions and building occupancy and which also has a daily unoccupied period usually at night, when air conditioning is not required.

As with most typical air conditioning systems, the system of the present invention comprises a compressor which could be any of the known forms such as reciprocating, rotary, or centrifugal. The system also comprises a condenser which could be water cooled, air cooled, or evaporatively cooled as is most common in moderately sized building systems. An evaporator coil is also part of the system which is utilized to directly cool the air being supplied throughout the building. Necessary refrigerant expansion devices are also a part of the system as such components are commonly used in cooling systems. The air cooling system also includes a thermal storage unit which usually comprises a thermally insulated tank substantially filled with a phase change material, typically water. The tank is usually sealed to prevent losses of the phase change material due to evaporation. Further, the tank includes tubing usually in the form of coil wound within the tank and connected between and inlet and an outlet. Such tubing permits a fluid to flow throughout much of the tank without physically contacting the liquid contained in the tank other than in a thermal manner with the working fluid flowing through the tubing and the phase change material outside the tubing filling the volume of the tank.

During the period when normal building cooling is required, the air cooling system operates in Mode #1, wherein conventional cooling is provided up to the maximum compressor capacity. In such operation, known well in the art, the compressor outlets compressed working fluid gas to the evaporative condenser wherein the working fluid is condensed to a liquid. The working fluid exits the evaporative condenser, enters the receiver and then enters the evaporator coil, by way of an expansion device, wherein the air passing across the coil is chilled and moved throughout the building.

The heat transferred to the partially vaporized working fluid completely vaporizes the remaining liquid in the presence of the relatively low pressure created by the compressor, and the working fluid as a gas flows to the compressor inlet to complete the cycle.

In the daily period when the building is not occupied and air conditioning is not required, the system can be operated in Mode #2. In such operation, the evaporator coil is switched out of the working fluid circuit and is replaced with the thermal storage unit. Accordingly, the working fluid liquid exiting the evaporative condenser, passes through the receiver, passes through an expansion device and then, as a partially vaporized fluid at a subfreezing temperature, passes through the thermal storage unit thereby freezing the phase change material in the thermal storage unit. The heat transferred from the freezing phase change material completely vaporizes the working fluid in the presence of the relatively low pressure created by the compressor, and the working fluid gas flows to the compressor inlet to complete the cycle. When the desired amount of phase change material is frozen, the system can be shut down for the remainder of the unoccupied period.

On days when supplemental cooling is required, usually the hottest days of the year, the air cooling system will have been operated during the unoccupied building period in Mode #2 to thereby freeze the phase change material in the thermal storage unit. As the day begins, the air cooling system of the present invention can be operated in Mode #1 wherein conventional cooling is provided to the maximum compressor capacity. However, usually during the afternoon hours when the supplemental cooling is required, the system can be switched to operate in Mode #3. In such mode of operation, the outlet of working fluid from the evaporative condenser flows through the receiver and then is passed first through the thermal storage unit for additional chilling and then to the evaporator coil. Accordingly, the phase change material, usually ice formed from freezing the water in the thermal storage unit tank, is gradually melted as the working fluid passing through the coil of the thermal storage unit is chilled. The additionally chilled working fluid passing into the evaporator coil from the thermal storage unit, by way of an expansion device, is capable of absorbing more heat from the chilled air before the fluid is fully vaporized and subsequently caused to flow to the compressor inlet. Accordingly, the additional degree of cooling is provided to keep the building at a desired temperature during such peak demand days. Typically, the compressor can be sized to only 75% of the system's maximum rating, with the extra 25% of capacity being provided by the thermal storage unit chilling process. Such full capacity can be provided for the entire time that ice remains in the thermal storage unit.

The air cooling system of the present invention provides several benefits. One such benefit is the reduced electricity demand due to overall smaller system sizing, overall smaller mechanical system component sizing, and the frequently encountered price penalties for electric demand during daytime hours and reduced pricing for electricity during the nighttime hours. Another advantage is that the thermal storage unit of the present invention is entirely integrated into the refrigeration circuit without the need for foreign fluids passing through such system. Accordingly, the system is not affected by corrosion due to improper chemistry control of a cooling water supply or foreign debris which may be contained in such supply. The entire air cooling system can be configured as a single unit, fully factory assembled. Accordingly, such unit is less costly to install than a system utilizing several separate components with necessary hookups and interconnections. Finally, the phase change material, usually water, used in the thermal storage unit can be partially melted and refrozen without concern for reliability or performance.

DESCRIPTION OF THE PREFERRED EMBODIMENT

Figure 1:
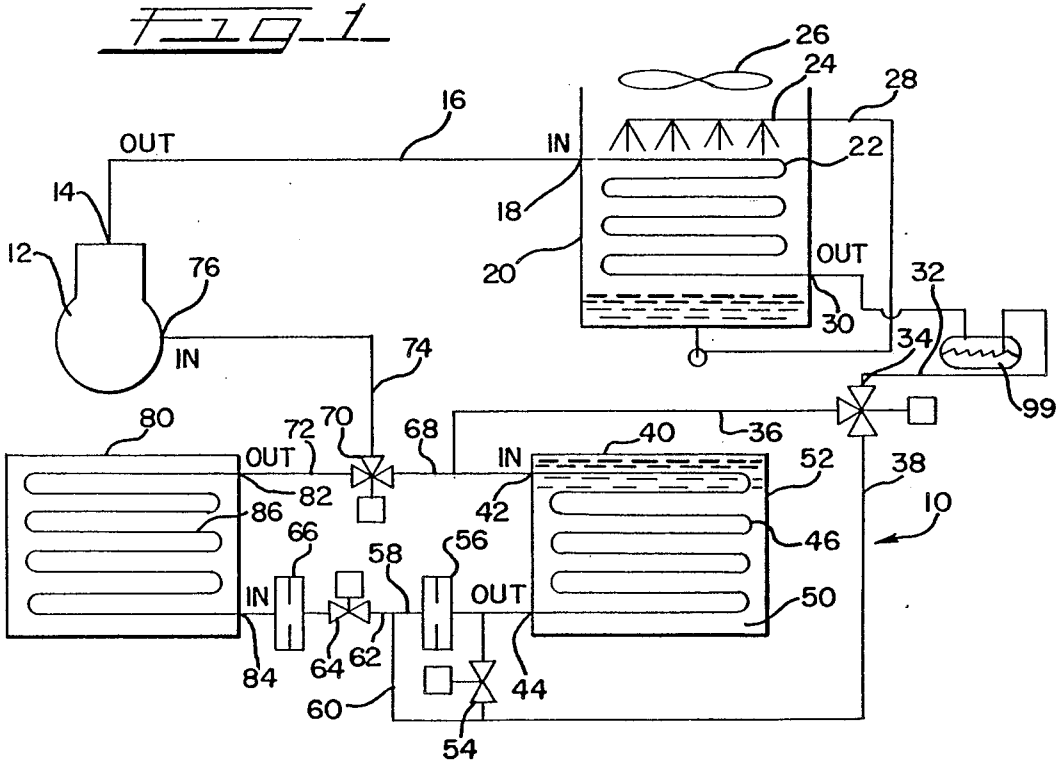
FIG. 1 is a schematic of an air cooling system in accordance with the present invention.

Referring now to FIG. 1 of the drawings, an air cooling system in accordance with the present invention is shown generally at 10. The main components of such a system comprise a compressor 12 which may be a reciprocating, rotary, or centrifugal compressor. Compressor 12 has an outlet 14 which connects to tubing 16 providing for the outlet of a working fluid, usually a gaseous refrigerant, from compressor 12 to the inlet 18 of evaporative condenser 20. Evaporative condenser 20 can be a water cooled, air cooled or evaporatively cooled (as shown) condenser. Inlet 18 is connected to internal tubing 22 which forms a coil in evaporative condenser 20 exiting at 30. Cooling water 28 being recirculated from beneath the coil 22 exits through a sprayhead system 24 such that cooling water falls over coil 22. An appropriate fan mechanism 26 is usually also provided.

Outlet 30 from evaporative condenser 20 connects to tubing 32 which connects to receiver 99. Receiver 99 has an outlet which enters a valve 34. Valve 34 has two outlets, 36 and 38. Outlet 36 extends to inlet 42 of thermal storage unit 40 and valve 70. Outlet 38 extends to valve 54 and section 60 which extends to valve 64. Valve 54 connects to outlet 44 of thermal storage unit 40, which is actually the outlet of coil tubing 46 extending from inlet 42 to outlet 44. Coil tubing 46 typically comprises metallic or plastic tubing wound in a serpentine manner throughout the tank 52 of thermal storage unit 40 such that the majority of the phase change material or water 50 can be frozen around the outside of tubing 46.

Outlet 44 of thermal storage unit 40 also can enter an expansion device 56 which in turn has an outlet 58 connected to tubing section 60 and section 62. Outlet 62 is connected to valve 64 which in turn is connected to expansion device 66 which has an outlet 84 to inlet 84 of evaporator coil 80. Evaporator coil 80 includes internal tubing 86 which extends from inlet 84 to outlet 82. Outlet 82 of evaporator coil 80 extends via tubing to valve 70, which in turn has an outlet 74 extending to inlet 76 of compressor 12. Evaporator coil 80 also includes air movement means whereby air to be cooled is passed across coil 86 and thereby distributed throughout the building to which air cooling system 10 is connected.

Preferably, expansion devices 66 and 56 are thermostatic expansion valves which sense the pressure and temperature of the refrigerant gas leaving the evaporator 80 at 82 and leaving the thermal storage unit 40 at 42 and thereby control the flow of liquid refrigerant from line 32 into the evaporator 80 and into the thermal storage unit 40 to insure all the refrigerant is vaporized therein and to prevent damage to the compressor by liquid refrigerant. Sufficient refrigerant is initially charged into the system to insure that liquid containing lines will be filled and into the evaporative condenser coil 22 in all modes of operation. Any variation in quantity of liquid refrigerant required from one condition to another is made up by maintaining an excess in the lower tubes of the evaporative condenser coil 22.

As is known in the art, alternative expansion devices such as orifices and capillary tubes may be applied to control refrigerant flow. Also external receivers may be employed to insure that liquid containing lines are full and to provide for refrigerant quantity variation from condition to condition when it is deemed undesirable to store excess in the evaporative condenser coil 22.

Figure 2:
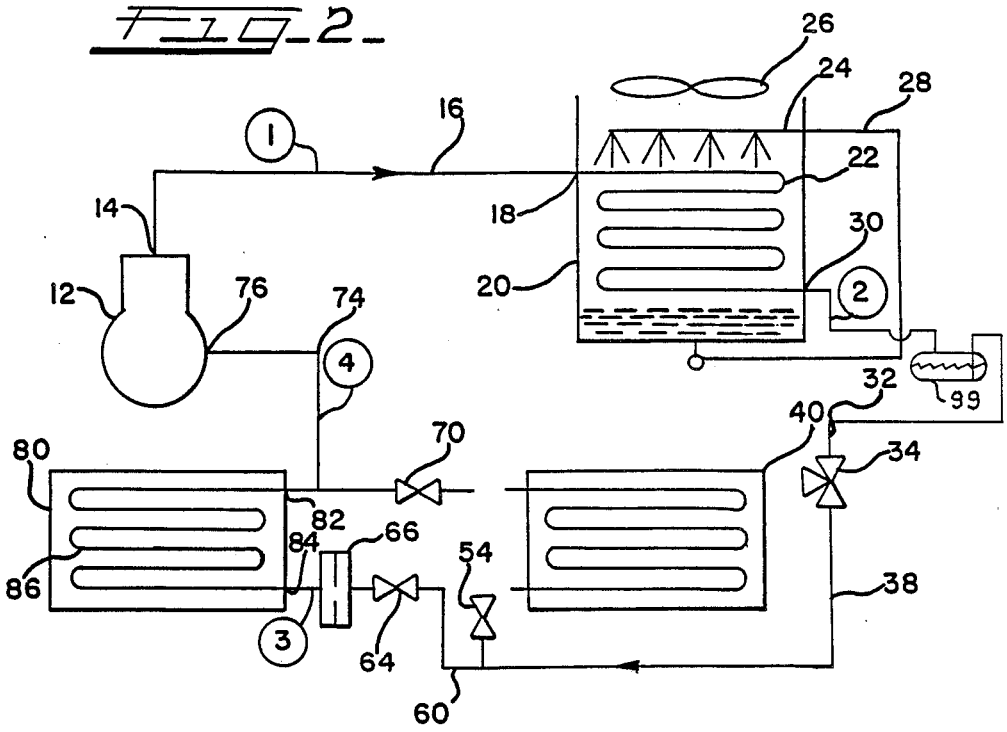
FIG. 2 is a schematic of an air cooling system in with accordance with the present invention operating in Mode #1 for conventional cooling.
Figure 3:
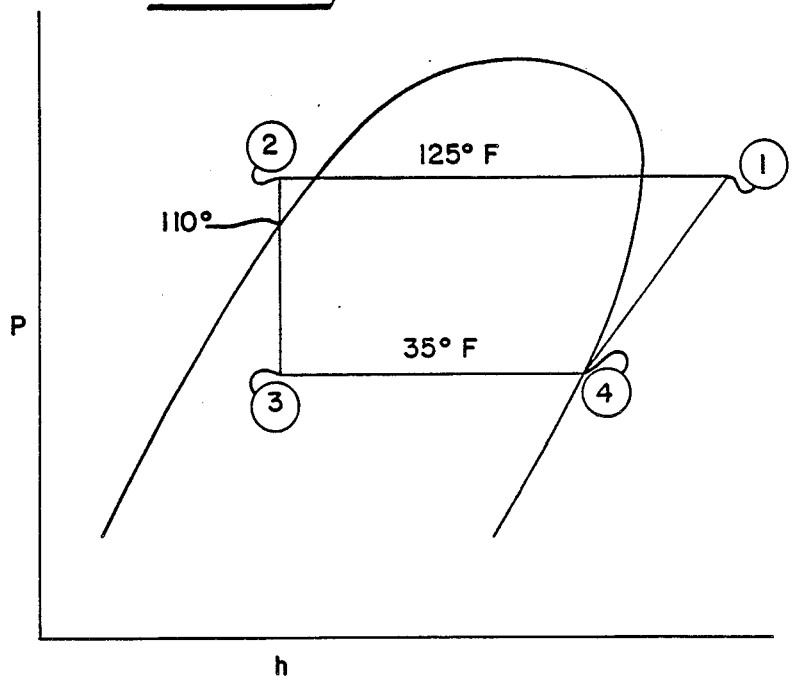
FIG. 3 is a diagram showing the operating parameters of the air cooling system of the present invention in Mode #1.

Referring now to FIGS. 2 and 3, Mode #1 of the air cooling system 10 will now be explained. Mode #1 provides conventional cooling to about 75% of the rated capacity of cooling system 10. In operation, outlet 14 of compressor 12 provides compressed working fluid, usually gaseous refrigerant, via line 16 to evaporative condenser 20. The cooled working fluid leaves outlet 30 of evaporator condenser 20 and passes through receiving 99 and then via line 32 through valve 34 and into line 38. From line 38 the pressurized and cooled working fluid passes through valve 64 and into expansion device 66. The expanded working fluid enters inlet 84 of evaporative coil 80 and passes through coil 86 thereby providing cooling to the air moving across coil 86. The warm and expanded working fluid leaves evaporative coil 80 at outlet 82 and enters lines 72 and 74 and inlet 76 of compressor 12. As can be seen, thermal storage unit 40 is bypassed in the Mode #1 operating condition for conventional cooling.

With reference now to FIG. 2 and 3, an explanation of the operating parameters of Mode #1 will now be provided.

FIG. 3 is a P-h diagram, showing the thermodynamic properties of the working fluid (refrigerant), having P, or pressure, as its ordinate and h, or enthalpy, as its abscissa. The curved line envelopes the properties of the fluid under saturated conditions with superheated gas to the right of the saturation envelope and subcooled liquid to the left of the saturation envelope.

Circled numbers in FIGS. 2 & 3 correspond to conditions in Mode #1 described herein. At condition 1, the warm, high-pressure gas being discharged from the compressor, can be seen in FIG. 3 to be superheated. As the gas passes into the coil 22 and is evaporatively cooled and caused to condense to a liquid at essentially a constant pressure, it can be seen on FIG. 3 to emerge from the coil 22 at condition 2. The amount of heat that was liberated during the condensing process is proportional to the difference in h, or enthalpy, between conditions 1 and 2.

As the working fluid passes through the expansion device 66, it passes from condition 2 to condition 3. Since there is no heat content change in this process, h remains constant while the pressure decreases. The working fluid is now a saturated mixture of gas and liquid.

As the fluid subsequently flows into the evaporator coil 86 at a low saturation pressure, the heat it absorbs from the air passing over the coil causes the liquid component to boil and become entirely a gas. The difference in the h values between conditions 4 and 3 is proportional to the amount of useful heat being transferred from the air to the working fluid.

Upon reaching the compressor at condition 4, the working fluid gas is again compressed to condition 1, wherein the difference in the h values between conditions 1 and 4 is proportional to the amount of work expended by the compressor to achieve the compression.

The above describes what is known in the art as a conventional refrigeration cycle. A condensing temperature of 125° F. and an evaporating temperature of 35° F. are shown as typical.

Figure 4:
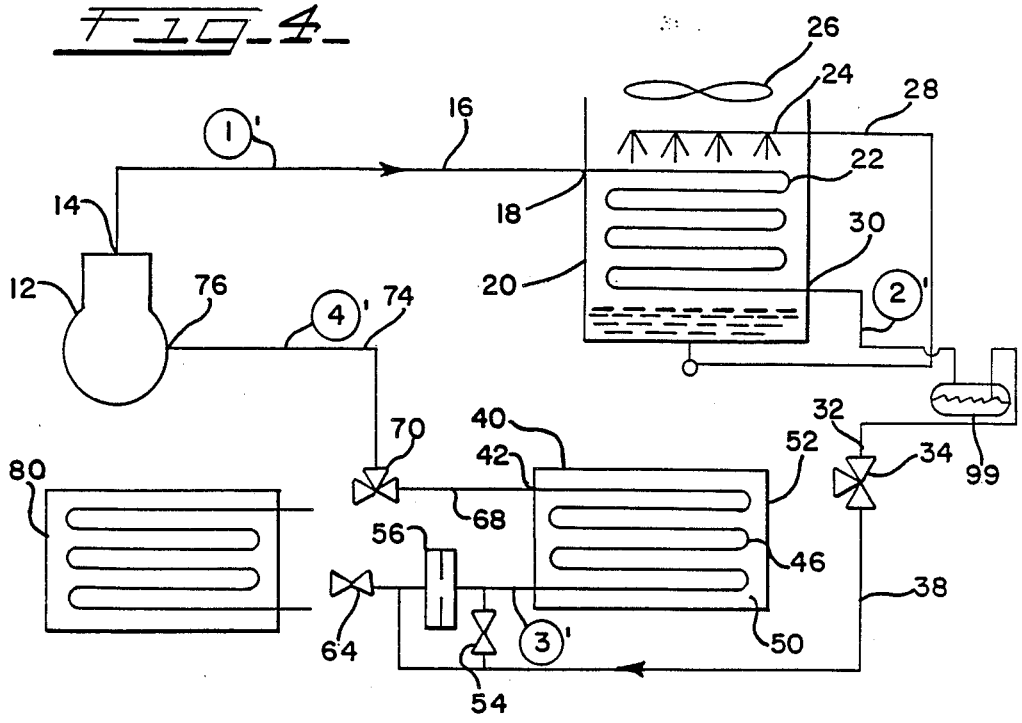
FIG. 4 is a schematic showing the air cooling system of the present invention operating in Mode #2 such that ice is formed in the thermal storage unit.

Referring now to FIG. 4, the operation of the air cooling system of the present invention in Mode #2, wherein no cooled air would be provided from the system to the building and ice would be formed in the thermal storage unit will now be provided. Compressor 12 provides at its outlet 14 compressed working fluid, usually a gaseous refrigerant, along line 16 to inlet 18 of evaporative condenser 20. Condensed and cooled working fluid exits evaporative condenser 20 at outlet 30 passes through receiver 99 and is supplied along 32 through valve 34 to line 38 and line 60 to expansion device 56. The expanded cooled working fluid enters outlet 44 of thermal storage unit 40 and flows along coil 40 to inlet 42 of thermal storage unit 40. In passing the expanded cooled working fluid through coil 36, the phase change material, usually water 50, is frozen around the outside of coil 46. The working fluid leaves inlet 42 and passes through line 68 through valve 70 into line 74 and into inlet 76 of compressor 12. Upon the formation of the desired amount of ice around coils 46 which normally would comprise the majority of the water 50, the air cooling system 10 is shut down for the remainder of the evening. Note that in Mode #2, the ice forming mode, evaporator coil 80 is not included in the routing of the working fluid through air cooling system 10 by appropriate positioning of the valves.

Figure 5:
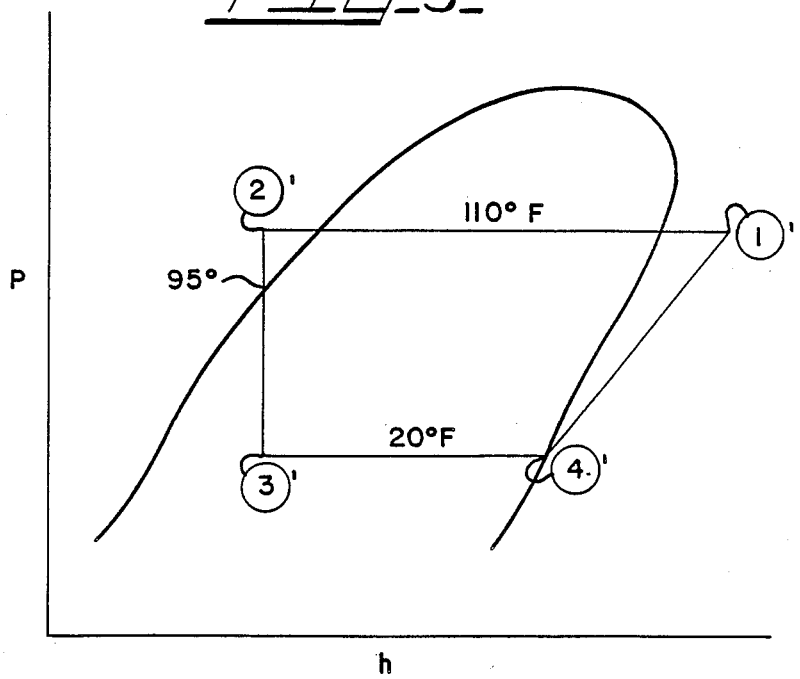
FIG. 5 is a diagram showing the operating parameters of the air cooling system of the present invention in Mode #2 wherein ice is formed in the thermal storage unit.

Referring now to FIG. 4 and 5, circled numbers in FIGS. 4 and 5 correspond to conditions in Mode #2 described herein. Warm compressed gas from the compressor at condition 1' flows into the coil 22 and is condensed and cooled at approximately a constant pressure. A condensing condition of 110° F. is now shown indicating this operation to be during the night when useful building cooling is not required and when ambient conditions are more moderate. The condensed liquid emerges from coil 22 at condition 2', passes through receiver 99 through expansion device 56 and enters the coil 46 at condition 3. Under this mode of operation, the pressure and corresponding saturation temperature in the coil must be lower than in Mode #1 in order to cause heat to flow to the boiling refrigerant liquid component from the freezing ice.

Upon becoming all gas and after absorbing heat from the freezing water, the working fluid emerges from the coil at condition 4' and is compressed once again to condition 1'.

Figure 6:
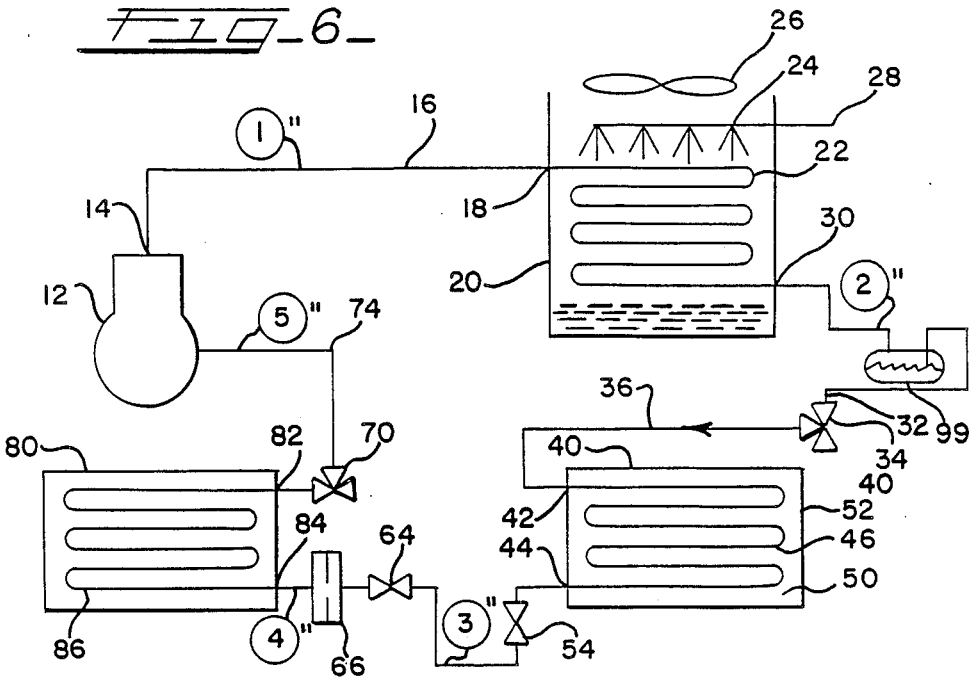
FIG. 6 is a schematic drawing of the air cooling system of the present invention operating in Mode #3 wherein supplemental cooling is required by the addition of the thermal storage unit to the cooling system.

Referring now to FIG. 6, an explanation of operating Mode #3 of air cooling system 10, which involves the use of thermal storage unit 40 in the air cooling system during operation, will now be provided. Compressor 12 provides compressed working fluid at its outlet 14 which is supplied via lines 16 to inlet 18 of evaporative condenser 20. Condensed and cooled working fluid exits condenser 20 at outlet 30, passes through receiver 99 and passes along line 32 to valve 34 and then along line 36 to inlet 42 of thermal storage unit 40. Working fluid passes along coil 46 through frozen water 50 thereby melting frozen water 50 which has built up upon coil 46 thereby further chilling working fluid as it passes through coil 46. Such further chilled working fluid exits thermal storage unit 40 at outlet 44 and passes through valve 54 and 64 into expansion device 66. The expanded and chilled working fluid enters evaporator coil 80 at inlet 84 and passes through coil 86 and exits evaporator coil at outlet 82. The warmed and expanded working fluid passes through valve 70 and line 74 back into inlet 76 of compressor 12. Air passing across coil 86 of evaporator coil 80 is provided enhanced cooling due to the lower entry temperature of working fluid when it enters inlet 84 as opposed to the operation in Mode #1. This enhanced cooling provides approximately 25% additional capacity to air cooling system 10 thereby permitting air cooling system 10 to provide its rated cooling capacity.

Figure 7:
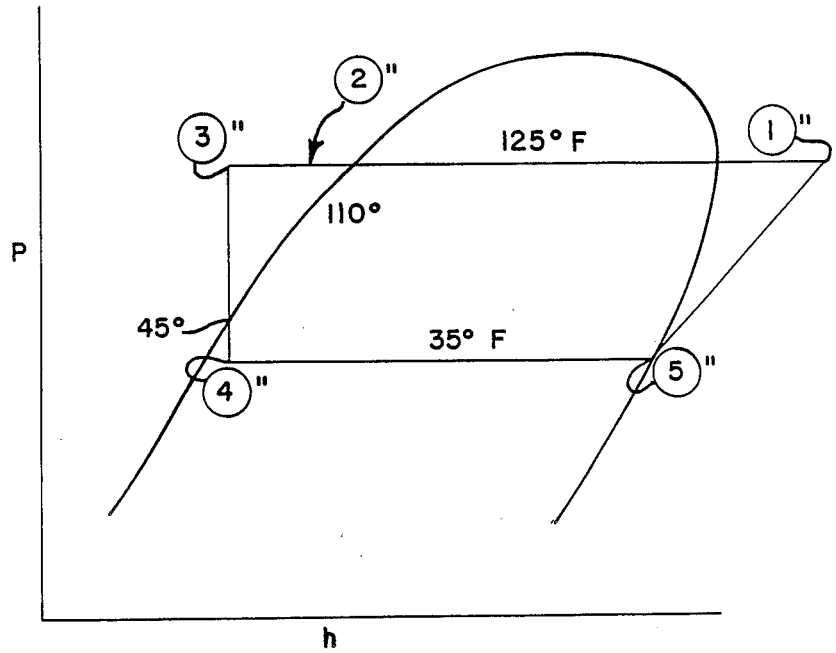
FIG. 7 is a diagram showing the operating parameters of the air cooling system of the present invention operating in Mode #3 when additional cooling is required.

Referring now to FIGS. 6 and 7, a description of the operating parameters of Mode #3 will now be provided. Circled numbers in FIGS. 6 and 7 correspond to conditions in Mode #3 described herein.

As in Mode #1 operation, the compressed gaseous working fluid leaves the compressor at condition 1'', passes into the evaporative condenser and is condensed to a liquid and is further cooled to condition 2''. But in contrast to Mode #1 operation, after leaving receiver 99 the high pressure liquid now passes through the coil of the thermal storage unit causing it to be cooled even further to condition 3'' by the melting ice.

The cold liquid passes through the expansion device 66 and flows to the evaporator at condition 4''. At condition 4'' and in contrast to Mode #1 operation, the working fluid is nearly all liquid with a much smaller component of gas. This is evident by the h value which is lower than in Mode #1. With more liquid fluid to boil, the fluid absorbs much more heat from the air passing over the evaporator coil as it transforms from condition 4'' to condition 5'', approximately 25% more.

At condition 5'', the fully gasified fluid is once more compressed by the compressor to condition 1.

The air cooling system of the present invention can accordingly operate in three different modes. In Mode #1, the air cooling system operates as an ordinary air conditioning system having a compressor 12, evaporative condenser 20, receiver 99 and evaporator coil 80. Such a system can be designed to provide the air conditioning needs of a building during the majority of the days during which air conditioning is needed. Lower electricity costs during the operating season are provided at essentially no increase in capital costs due to the smaller compressor and smaller evaporative condenser offsetting the added cost of the thermal storage unit. The evaporator coil is identical with that of the conventional system since it must be sized for the maximum building load in both cases. In Mode #2, when the building is not occupied and no air conditioning need be provided, air cooling system 10 can be operated with compressor 12, evaporative condenser 20 receiver 99 and thermal storage unit 40 operating in series with evaporative coil 80 not included in the path of the operating system. Such operation provides extra chilled working fluid to the thermal storage unit 40 thereby freezing water around the coils 46 of thermal storage unit 40. When sufficient ice is formed around coils 46, the air cooling system is shut down for the rest of the night. In Mode #3, which is utilized only during those days and times when the full rated cooling capacity of air cooling system 10 is necessary, extra cooled air is provided by air cooling system 10. Such cooling is provided with the operation of compressor 12, evaporative condenser 20, receiver 99 thermal storage unit 40, and evaporative coil 80 operating in series. Working fluid entering thermal storage unit 40 is further chilled due to the ice surrounding coils 46 in thermal storage unit 40 thereby providing extra chilled fluid to evaporative coil 80. Accordingly, air passing across evaporative coil 80 is supplementally chilled to the full rated capacity of air cooling system 10 thereby providing the building the supplemental cooling needed to meet the cooling load of the hottest days of the year. Such additional cooling is provided without sizing of air conditioning system 10 with compressors and, evaporative condensers rated to meet such extreme demands, but rather, such components need only be sized to about 75% of such peak demands with the extra 25% of cooling provided by the thermal storage unit 40.

What is claimed is:

1. A method of cooling air comprising the steps of passing a working fluid through a compressor means, then passing the working fluid through a condenser means, then passing the working fluid through a receiver means, then operating in one of three modes, wherein the first mode includes the further steps of passing the working fluid as a liquid from the receiver means through an expansion device to form a gas-liquid two-phase mixture of the working fluid, and then passing the two-phase mixture through an evaporator means to cool air passing through the evaporator means and change the working fluid into a gas and then passing the working fluid back to the compressor means, wherein the second mode includes the further steps of passing the working fluid as a liquid from the receiver means through an expansion device and then into tubing passing through thermal storage means to freeze a phase change material therein and change the working fluid to gas and then passing the working fluid back to the compressor means, and wherein the third mode includes the further steps of passing the working fluid as a liquid from the receiver means through the tubing in a thermal storage means having a frozen phase change material therein to further chill the working fluid liquid in the coil by melting said phase change material, passing the working fluid liquid through an evaporator means to cool air passing through the evaporator means and change the working fluid into a gas and then passing the working fluid gas back to the compressor means.

2. The method of cooling air of claim 1 wherein in the second mode of operation the phase change material is frozen around the outside of the tubing in the thermal storage means.

3. The method of cooling air of claim 1 wherein the thermal storage means comprises a tank and the phase change material comprises water or a eutectic salt.

4. A cooling system comprising a compressor means having an inlet and an outlet for a working fluid, a condenser means having an inlet and an outlet for a working fluid and a condenser coil through which the working fluid passes, an evaporator means having an inlet and an outlet for a working fluid and an evaporator coil through which the working fluid passes, a first expansion means at the inlet of said evaporator means, a receiver means having an inlet and an outlet and a reservoir for the working fluid, and a thermal storage means having an inlet and an outlet for the working fluid and a freezing coil through which the working fluid passes, a second expansion means at the outlet of the thermal storage means, wherein the compressor means outlet is connected to the condenser means inlet, the condenser means outlet is connected to the receiver means inlet, first valve means provided such that the receiver means outlet is alternatively connected to the thermal storage means or the evaporator means, second valve means provided such that the thermal storage means is alternatively connected to the evaporator means or the compressor means, said first and second valve means being operated such that, in a first mode of operation, said receiver means outlet is connected to said first expansion means and the inlet of said evaporator means, bypassing said thermal storage means, in a second mode of operation, said receiver means outlet is connected to said second expansion means and said thermal storage means and said thermal storage means is connected to the compressor means inlet, bypassing said evaporator means, and in a third mode of operation, said receiver means outlet is connected to said thermal storage means inlet and said thermal storage means outlet is connected to said first expansion means and said evaporator means.

5. The cooling system of claim 4 wherein the thermal storage means comprises tubing connected between the thermal storage means inlet and outlet, a tank containing a liquid, with the tubing routed through the tank such that a substantial portion of its length is under the liquid.

6. The cooling system of claim 5 wherein the tubing is routed through the tank such that a majority of the liquid can be frozen around the tubing.

7. The cooling system of claim 4 wherein the working fluid is a liquid refrigerant.

8. The cooling system of claim 4 wherein the liquid in the thermal storage means tank is water.

* * * * *